US006634395B1

(12) United States Patent
Mitchell

(10) Patent No.: US 6,634,395 B1
(45) Date of Patent: Oct. 21, 2003

(54) DOUBLE POPPET VALVE FOR PRECISE SHUT OFF OF FUEL DISPENSING NOZZLE

(75) Inventor: Thomas O. Mitchell, Maryland Heights, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 10/126,047

(22) Filed: Apr. 19, 2002

(51) Int. Cl.[7] ..... B67D 5/00
(52) U.S. Cl. ..... 141/128; 141/209
(58) Field of Search ..... 141/128, 198, 141/206, 209–211, 214, 215, 217, 218, 227, 228

(56) References Cited

U.S. PATENT DOCUMENTS

| | | | | |
|---|---|---|---|---|
| 3,118,475 A | * | 1/1964 | Hammond | 141/224 |
| 3,838,711 A | | 10/1974 | Ellett | |
| 4,453,578 A | * | 6/1984 | Wilder | 141/209 |
| 4,522,223 A | | 6/1985 | Balsys et al. | |
| 4,850,392 A | | 7/1989 | Crump et al. | |
| 5,022,436 A | | 6/1991 | Portolese | |
| 5,085,179 A | | 2/1992 | Faulkner | |
| 5,133,309 A | | 7/1992 | Ishii | |
| 5,156,181 A | | 10/1992 | Maalouf et al. | |
| 5,244,006 A | | 9/1993 | Pettesch | |
| 5,566,703 A | | 10/1996 | Watanabe et al. | |
| 5,609,401 A | | 3/1997 | Johnston et al. | |
| 5,722,373 A | | 3/1998 | Paul et al. | |
| 5,850,852 A | | 12/1998 | Russell et al. | |
| 5,910,244 A | | 6/1999 | Stamos | |
| 5,918,633 A | | 7/1999 | Zeiber | |
| 5,996,348 A | | 12/1999 | Watkins | |
| 6,077,158 A | | 6/2000 | Lake et al. | |
| 6,082,128 A | | 7/2000 | Lake et al. | |
| 6,089,034 A | | 7/2000 | Lake et al. | |
| 6,092,376 A | | 7/2000 | Lake et al. | |
| 6,155,293 A | | 12/2000 | Haselden, Jr. et al. | |
| 6,318,396 B1 | | 11/2001 | Haselden, Jr. et al. | |

* cited by examiner

*Primary Examiner*—J. Casimer Jacyna
(74) *Attorney, Agent, or Firm*—Paul M. Denk

(57) ABSTRACT

A fuel dispensing nozzle incorporating a double poppet valve assembly enables a user to more controllably and accurately dispense fuel through the nozzle. The double poppet valve assembly has a larger outer poppet and a smaller inner poppet, such that the user can open both poppets together or merely open the smaller inner poppet alone. The outer poppet enables a high rate of fuel to flow through the nozzle when the outer poppet is opened. The inner poppet, located within the body of the outer poppet, allows a reduced rate of fuel to flow through the nozzle when the inner poppet is opened but the outer poppet is closed, enabling the user to dispense more precise amounts of fuel.

17 Claims, 2 Drawing Sheets

DOUBLE POPPET VALVE FOR PRECISE SHUT OFF OF FUEL DISPENSING NOZZLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a novel valve assembly for a gas dispensing nozzle to allow a user to better regulate the flow of fuel through the fuel dispensing nozzle, and more particularly to a valve assembly which allows a user to controllably dispense small amounts of fuel through such a nozzle.

Fuel dispensing nozzles are long known in the art, and are used throughout the world to enable a user to controllably regulate the flow of fuel from a storage tank into a user tank, such as a gasoline tank in an automobile. In order to facilitate the rapid and efficient dispensing of the fuel from a storage tank to a user tank, fuel dispensing systems are designed to operate at a very high fluid flow rate. The fuel is pumped from the storage tank and through a metering system that tracks and records the amount of fuel dispensed by each user. The fuel then flows through a fuel line from the metering system to a dispensing nozzle that is placed in an orifice attached to the user tank to enable the dispensing of fuel from the storage tank into the user tank.

Generally, the typical dispensing nozzle includes a handle that actuates a spring-loaded valve within the nozzle. When the handle is squeezed by the user, the valve opens to allow fuel to flow freely through the valve, through the nozzle, and into the user tank. When the handle is released, the spring shuts the valve, and thereby shuts off the flow of fuel. A variety of poppet valve configurations, also known in the art, are often used for this purpose in existing fuel dispensing nozzles.

Due to the desirability of high fuel flow rates, and the need for a reliable, positive shut-off of fuel for safety purposes, the spring that operates the poppet valve in most dispensing nozzles is very strong and requires a substantial force to compress.

Typically, the handles on dispensing nozzles operate as cantilevers to enable the user to overcome the force of the valve spring. Unfortunately, this flow control scheme is somewhat course, and the arrangement therefore offers the user only limited control over the amount of fuel dispensed through the dispensing nozzle. Historically, while such limited control over the dispensing of fuel was often a nuisance to the user, demand for more precise control did not warrant modification of the fuel dispensing systems. Recently, however, economic conditions and the rising costs of fuel have driven demand for more precise control over the dispensing of fuels, particularly in developing countries.

Accordingly, it would be desirable to have a valve assembly design that not only allows a user to dispense fuel at a rapid flow rate, but also allows the user to control the amount of fuel dispensed with more precision than current valve designs afford. Further, it would be desirable for such a valve assembly to be compatible with, and could be readily incorporated into, existing dispensing nozzles, without the need to reconfigure or modify the existing nozzle design.

SUMMARY OF THE INVENTION

The present invention resides in a valve assembly design that incorporates both an outer poppet for regulating the rapid flow of fuel, and an inner poppet for regulating a slower flow of fuel that can be controlled more precisely by the user. This double poppet valve can be incorporated into existing fuel dispensing nozzles that presently employ more traditional poppet valves without requiring modification to the nozzle.

When the handle for a nozzle housing such a double poppet valve is squeezed with sufficient force to overcome the primary spring atop the valve, the outer poppet opens to allow fuel to flow rapidly through the nozzle. Releasing the handle allows the valve spring to close the valve and shut off the flow of fuel.

Yet, the inner poppet itself is spring-loaded within the double poppet valve. However, the magnitude of the spring force on the inner poppet is less than magnitude of the force applied to the outer poppet by the valve spring.

Accordingly, when the nozzle handle is squeezed gently, with sufficient force to overcome the spring force on the inner poppet but insufficient to overcome the spring force on the outer poppet, an opening forms about the inner poppet.

The opening is smaller than the opening that forms about the outer poppet when open, and therefore will only allow fuel to flow through the nozzle at a rate less than the rate about the outer poppet when open. This allows the user to more precisely control the amount of fuel dispensed through the nozzle by more rapidly and easily shutting off the flow of fuel when a desired amount of fuel has been dispensed.

Hence, the present invention provides a simple to operate mechanism that enables a user to more precisely regulate the amount of fuel the user wishes to dispense through a fuel dispensing nozzle in the form of a double poppet valve within the nozzle that readily replaces more traditional poppet valves in existing fuel dispensing nozzles without the need to modify such nozzles.

The present invention is readily adaptable to numerous shapes and sizes, and may be constructed of many materials, such as fibers, plastics and metals.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
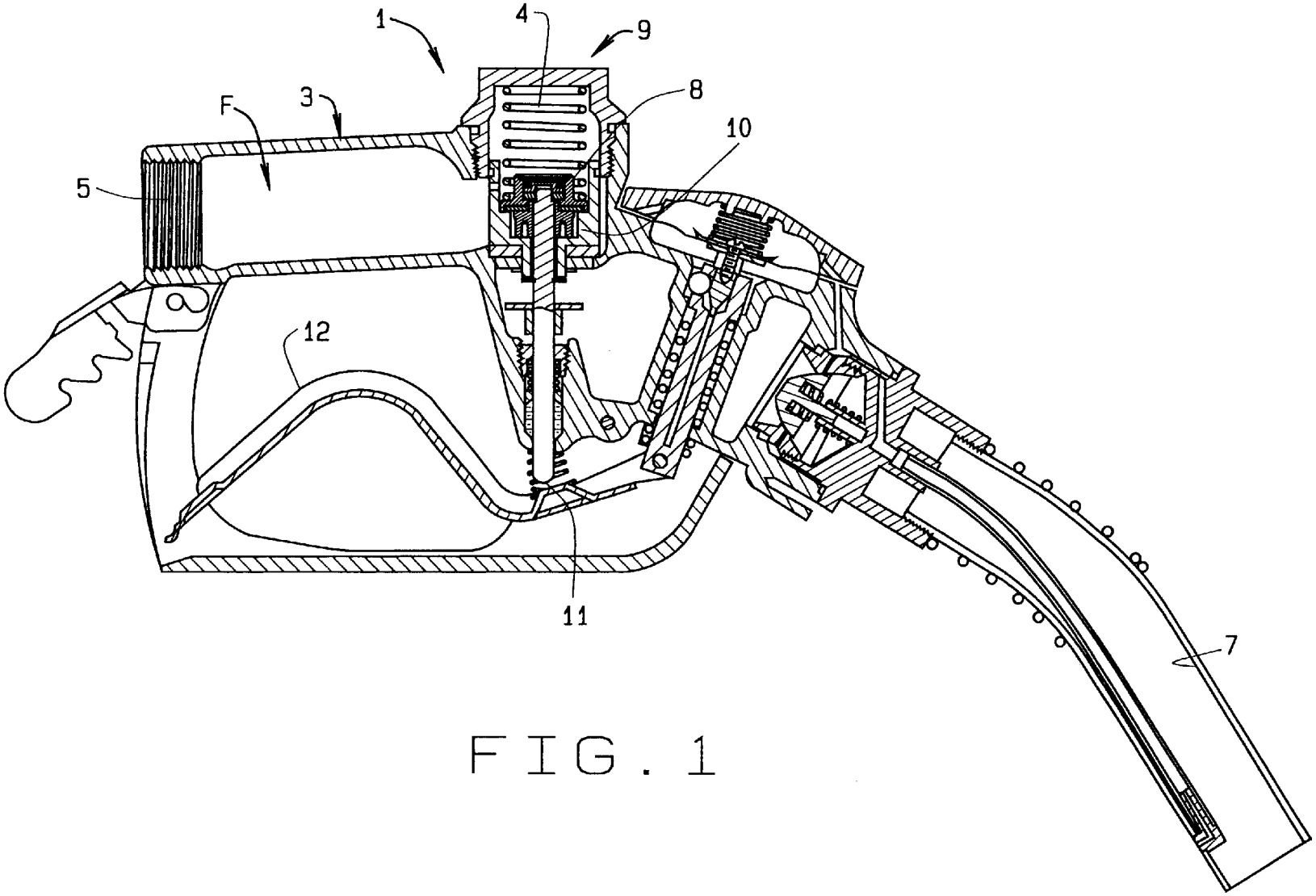
FIG. 1 is a cross-sectional side elevation of a fuel dispensing nozzle containing the preferred embodiment of the novel valve assembly.

A fuel dispensing nozzle of the present invention is indicated generally at 1 (FIG. 1). The nozzle 1 includes a housing 3 of cast aluminum, or other suitable material, through which runs a fluid flow path F, with an inlet 5 and a spout 7. A valve assembly 9 is disposed within the flow path F and includes a valve body 8 that cooperates with a main valve seat 10 in the flow path F. The valve assembly 9 may be used for newly manufactured fuel dispensing nozzles or may be used as a replacement for valve assemblies in existing nozzles. A valve stem 11 extends between the bottom of the valve body 8 and the midsection of a handle 12 pivotally mounted at one end within the body 3 of the nozzle. A spring 4 is positioned in the housing 3 above the valve body 8 to bias the body toward the main seat 10. As can be appreciated, by lifting up on the handle 12, the valve body 8 will be lifted off the seat 10 to allow fuel to flow through the nozzle. When the handle is released, the spring 4 will force the valve body 8 against the seat 10 to prevent the flow of fuel through the nozzle.

Figure 2:
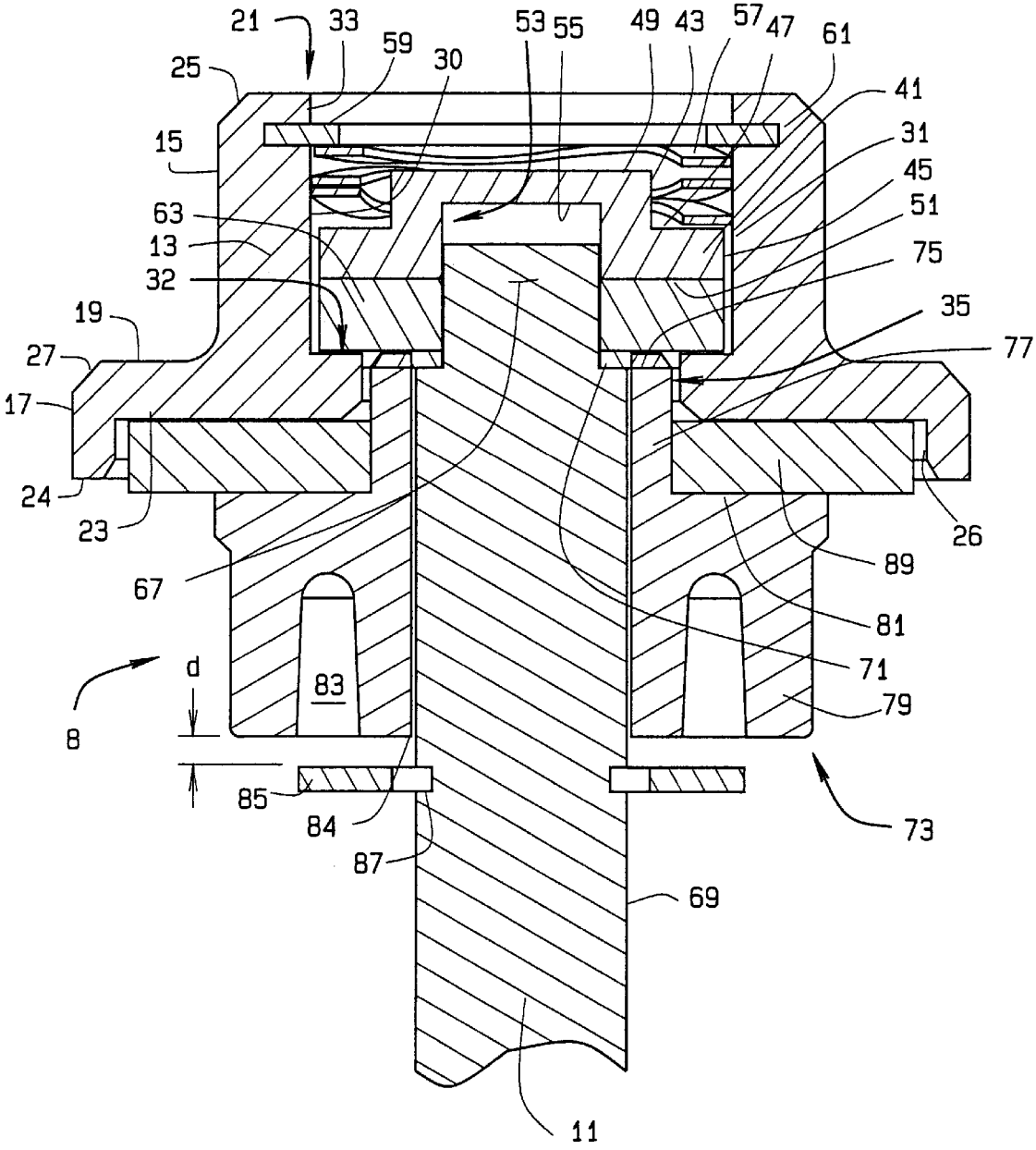
FIG. 2 is a cross-sectional side elevation of the preferred embodiment of the novel valve assembly isolated from the fuel dispensing nozzle.

As can be seen more readily from FIG. 2, the valve body 8 includes an outer poppet 13, having a cylindrical body 15 and a flange 17 extending from the bottom of the body 15 to form a horizontal shoulder 19. An upper surface 21 and a lower surface 23, along the top and bottom of the outer poppet 13, respectively, are both generally flat and parallel with the shoulder 19. A rim 24 extends down from the lower surface 23. The edges of the upper surface 21 and the shoulder 19 are beveled to form edges 25 and 27, respectively. The rim 24 and lower surface 23 define a recess 26. A seal 89 is received in the recess 26.

A chamber 30 is formed in the outer poppet 13 and is defined by a preferably cylindrical wall 31 and a floor 32. While the chamber 30 is preferably cylindrical, it may be formed in various other shapes. An outlet 33 from the chamber 30 opens into the poppet top surface 21. The outlet 33 has a diameter approximately equal to the diameter of the chamber 30. An inlet 35 at the bottom of the chamber 30 opens into the lower surface 23 of the outer poppet 13. The inlet 35 is preferably cylindrical, but may be formed in various other shapes.

An inner poppet 41 is positioned within the chamber 30 of the outer poppet 13. The inner poppet 41 is includes an upper body 43 with a flange 45 extending from the bottom of the body 43, and having an upper surface 49 and a lower surface 51, and a shoulder 47 there between. The inner poppet flange 45 has a diameter slightly less than that of the chamber 30, yet greater than that of the inlet 35, to enable the inner poppet 41 to move axially within the chamber 30. The upper and lower surfaces 49 and 51, respectively, of the inner poppet 41 are both generally flat and parallel with the shoulder 47. A bore 53 extends into the inner poppet from the bottom surface 51 to a ceiling 55 within the body of the inner poppet.

A spring 57, having an outer diameter less than that of the outer poppet chamber 30, encircles the inner poppet body 43, such that the spring presses against the inner poppet shoulder 47 and against a retaining clip 59 located in a circular groove 61 near the chamber outlet 33. A flat, circular inner poppet seal 63, constructed of rubber or other acceptable material such as nylon or plastic, is positioned in the outer poppet chamber 30 between the inner poppet body flange 45 and the floor 32 of the outer poppet chamber. When the inner poppet is closed, the inner poppet seal 63 forms a liquid-tight seal with the chamber floor 32 to close the opening into the chamber 30 to prevent the flow of fuel through the chamber.

The valve assembly valve stem 11 comprises an upper portion 67 and a lower portion 69. The upper portion 67 has a diameter less than that of the lower portion 69 such that a generally flat shoulder 71 is formed at the interface between the two portions. The stem 11 extends through the inlet 35 in the outer poppet chamber 30 and the stem portion 67 extends through the inner poppet seal 63 and into the inner poppet bore 53. The stem portion 69 is smaller in diameter than the inlet 35 into the outer poppet chamber 30. The stem shoulder 71 engages the underside of the inner poppet seal 63. Hence, when the stem 11 is raised, by action of the lever, the inner poppet seal will be lifted off the outer poppet chamber floor 32 and open the inner poppet valve to allow fuel to flow into and through the chamber 30. As can be appreciated, the chamber floor 32 defines a seat for the inner poppet 41.

A skirt 73 is journaled about the lower portion 69 of the valve stem 11 such that the stem 11 can move axially relative to the skirt. The skirt 73 is formed of plastic or other suitable material. It comprises an upper portion 77 having an upper surface 75 and a lower portion 79 having a diameter greater than the upper portion. The upper and lower portions define a flat shoulder 81. A deep circular groove 83 is also formed in the underside of the lower portion 77 of the skirt 73. A bore 84 extends through the skirt 73, and the valve stem 11 extends through the skirt bore. A retaining ring 85 is positioned in a circular horizontal groove 87 formed in the lower portion 69 of the valve stem 11. The retaining ring 85 prevents the skirt 73 from sliding down the valve stem 11 beyond the groove 87. Importantly, the retaining ring 85 is spaced a distance d below the bottom surface of the skirt when the skirt shoulder 81 engages the outer poppet seal 89.

Referring again to FIG. 1, the outer poppet 13 is movable between a fully closed position (as shown in FIG. 1) in which the valve assembly 9 blocks the flow of fuel through the dispensing nozzle, and an open or raised position (not shown) in which the outer poppet seal 89 is clear of valve seat 10 so as to permit the rapid flow of fuel from inlet 5 to spout 7. Additionally, the inner poppet 41 is also movable between a fully closed position (as shown in FIG. 2) in which the inner poppet 41 prevents the flow of fuel through the chamber 30 in the outer poppet 13, and an open or raised position (not shown) in which the inner poppet seal 63 is clear of inner valve seat 32 to permit a reduced flow of fuel from inlet 5 to spout 7 through the chamber 30.

When the handle 12 is raised, as by a user desiring to pump gasoline through the nozzle 1, the handle 12 engages and pushes in an upward direction the valve stem 11 (FIG. 1). The upward movement of the valve stem 11 initially pushes valve stem shoulder 71 against the bottom of the inner poppet seal 63, thereby raising the inner poppet base 43 off the valve seat 32, and against the pressure exerted by the spring 57. Because the spring 4 exerts a compressive force downward against the outer poppet 13 that exceeds the compressive force applied by the spring 57 against the retaining ring 59 when fully compressed by the upward movement of the valve stem 11, the outer poppet 13 will remain in its closed position while the inner poppet 41 moves to an open position, to allow fuel to flow through the chamber 30 at the reduced flow rate.

As the valve stem 11 continues to move upward, the retaining ring 85 on the stem 11 engages and pushes the skirt 73 upward, raising the seal 63 and inner poppet 41 off the valve seat 10, thereby allowing fuel to flow between the inlet 5 and spout 7 around the perimeter of the outer poppet 13, past the seal 89 and the valve seat 10 (FIG. 1) at a high flow rate. As can be appreciated, after the inner poppet is opened, the valve stem travels the distance d before the retaining ring 85 engages the skirt 79 to open the outer poppet 21.

Accordingly, movement of the handle 12 and valve stem 11 can be controlled to open the inner poppet 41 to allow a limited flow of fuel between the inlet 5 and spout 7 through the outer poppet cavity 30 without releasing the higher fuel flow that would accompany the opening of the outer poppet 13. The present invention, therefore, enables a user to readily and controllably dispense small quantities of fuel through the nozzle 1.

The present invention, thus, enables a user to easily, accurately and controllably dispense small quantities of fuel through the same nozzle 1 through which large volumes of fuel may also be dispensed. By merely controlling the degree the handle 12 and the stem 11 are raised, the user can select between high and low fuel flow rates in the same nozzle 1. A slower, yet more accurate and controllable dispensing of fuel through the nozzle 1 is achieved by squeezing the handle 12 only slightly so that the stem 11 opens only the inner poppet 41. Rapid, but relatively coarse dispensing of fuel through the nozzle 1 is achieved by squeezing the handle 12 sufficiently such that the stem 11 opens both the inner and outer poppets. In this way, small volumes of fuel can be dispensed through the outer poppet chamber 30 at a low rate so as to allow the user to determine more precisely when to release the handle 12 to shut off the flow.

One of the important benefits of the present invention is revealed by the following example. It has been shown that in a conventional fuel dispensing nozzle, the flow rate when the conventional fuel flow valve is fully open is approximately 10 gallons per minute (gpm), and the user can controllably reduce this flow rate to approximately 2 gpm when the fuel flow valve is nearly closed. This means that at a price of $1.00 US per gallon, at 2 gpm, the user is dispensing fuel at a rate of 1 penny every 0.3 seconds. At this flow rate, an experienced user can precisely stop the flow of fuel at a desired amount. However, when the price of fuel is $4.00 per gallon, the fuel flow equates to 1 penny every 0.075 seconds and is too rapid even for an experienced user to controllably stop the fuel flow at a desired amount.

In contrast, by using the double poppet valve assembly of the present invention, the fuel flow rate can be controllably reduced by an experienced user to approximately 0.25 gpm. At $4.00 per gallon, this equates to 1 penny every 0.6 seconds, which enables the user to stop the flow of fuel at a desired amount. Hence, by using a nozzle 1 with the present invention, a user can operate the nozzle 1 to dispense fuel at a lower rate of approximately 0.25 gpm when only the inner poppet 41 is opened or at the higher rate of about 10 gpm when the outer poppet 13 is opened. As can be appreciated, by changing the sizes of the valve openings, the valve assembly can be machined to provide different desired flow rates.

Other variations on the basic apparatus are also available. For example, any number of well-understood mechanisms may be used to apply an upward force to the valve stem 11 other than a handle 12, including, but not limited to levers, buttons, cranks, gears and screws. The valve assembly 9 may be positioned at a location along the fuel flow path F between the inlet 5 and the outer end of the spout 7. The entire valve assembly 9 may be placed in any orientation within the nozzle housing 3, such that pressure may be applied to the valve stem 11 from the top, bottom or any side of the housing. The inner and outer poppets 13 and 41, and the valve stem 11 may be configured differently than in the preferred embodiment, and can, for example, be non-cylindrical in shape, of differing sizes relative to one another, and longer or shorter in length. Similarly, the chamber 30 and the inlet 35 may be cylindrical, or may be non-cylindrical in shape, of differing sizes relative to one another, and longer or shorter in depth. A number of various devices and means may be substituted for the rings 59 and 85, such as, for example, cotter pins, nuts and washers. Similarly, the valve stem 11 may be reconfigured to incorporate a shoulder, rib or similar feature, to replace the retaining ring 85, and a removable cap could be incorporated into the top of the outer poppet 13 to replace the retaining ring 59.

Additionally, any number of resilient compressive devices may be substituted for the springs 4 and 57, including, for example, any of the multitude of varying spring designs, spring metal plates, and plugs or tubes made of a resilient material such as rubber. Further, the dimensions of the apparatus can vary significantly, including, but not limited to, widening or thinning of each of the components together or relative to one another, so long as the general operation of the apparatus is not defeated. Finally, each of the components of the invention can be manufactured from a variety of materials, including, but not limited to, plastics and metals, so long as the apparatus maintains the same functionality and the necessary structural integrity.

The inner and outer poppets 41, 13 could be configured to eliminate the skirt 73 from the valve assembly 8. In such a configuration, the ring 85 could, for example, be resized relative to the stem 11, such that it is the ring 85 that contacts, and raises, the outer poppet 13 with, for example, a second shoulder or a flange formed on the stem 11.

As various changes could be made in the above constructions without departing from the scope of the invention, it is intended that all matter contained in the above description or shown in the accompanying drawings shall be interpreted as illustrative and not in a limiting sense.

I claim:

1. A fuel dispensing nozzle comprising a body, a fuel flow path within the body, an inlet formed at one end of the fuel flow path, a spout formed at the other end of the fuel flow path, and a valve assembly positioned along the fuel flow path and being movable between a closed position in which fuel flow through the nozzle is prevented, a first opened position in which fuel flows at a first rate through the nozzle, and a second opened position in which fuel flows through the nozzle at a second rate faster than said first rate, the valve assembly comprising:

a. a first valve seat in said fuel flow path;

b. an outer poppet movable between a closed position and an open position, the outer poppet comprising a body having a sealing surface that engages the valve seat when the outer poppet is in its closed position, and a chamber within the outer poppet having a second valve seat therein and a pair of openings to allow fuel to flow through the outer poppet;

b. a first compressive member located in the nozzle body and positioned to bias the outer poppet to its closed position; and d. an inner poppet located within the chamber of the outer poppet and in the fuel flow path, the inner poppet being movable between a closed position in which the inner poppet engages the second valve seat to prevent the flow of fuel through the outer poppet chamber and an open position in which the inner poppet is spaced from the second valve seat to allow the flow of fuel through the outer poppet chamber;

e. a second compressive member located in the outer poppet chamber and positioned to bias the inner poppet to its closed position; and f. an opening mechanism that moves the outer poppet and the inner poppet between their respective open and closed positions, said opening mechanism opening the inner poppet prior to opening the outer poppet.

2. The nozzle of claim 1, wherein the opening mechanism comprises a valve stem having a first end and a second end, the first end operatively engaging the inner poppet, wherein axial movement of the valve stem moves the inner poppet and outer poppet between their respective open and closed positions.

3. The nozzle of claim 2, further comprising a lever that operatively engages the second end of the valve stem to move the valve stem axially.

4. The nozzle of claim 1, wherein the valve assembly further comprises an outer poppet seal adjacent a bottom surface of the outer poppet, said outer poppet seal sealing against the first valve seat when the valve assembly is in its closed position.

5. The nozzle of claim 1, wherein the valve assembly further comprises an inner poppet seal between the inner poppet and the second valve seat, said inner poppet seal sealing against the second valve seat when the inner poppet is in its closed position.

6. The nozzle of claim 5, wherein the valve assembly further comprises a retainer located within the outer poppet chamber to maintain the second compressive member, the inner poppet and the inner poppet seal within the body chamber of the outer poppet.

7. The nozzle of claim 1, wherein the valve assembly further comprises an engagement member along the valve stem, said engagement member operatively engaging the outer poppet to move said outer poppet to its open position upon the upward movement of the valve stem.

8. The nozzle of claim 7, wherein said engagement member comprises a retaining ring on said valve stem.

9. The nozzle of claim 7, wherein the valve assembly further comprises a skirt that encircles the valve stem between the engagement member and the outer poppet, said engagement member operatively engaging the skirt to move said outer poppet to its open position upon the upward movement of the valve stem.

10. A valve assembly for a fuel dispensing nozzle comprising:

a. an outer poppet, the outer poppet comprising a body, and a chamber within the outer poppet body, said chamber having a flow path, a valve seat in said flow path, and a pair of openings to allow fuel to flow through the outer poppet chamber;

b. an inner poppet located within the body chamber of the outer poppet, the inner poppet being movable between a closed position in which the inner poppet engages the valve seat to prevent the flow of fuel through the outer poppet chamber and an open position in which the inner poppet is spaced from the second valve seat to allow the flow of fuel through the outer poppet chamber;

c. a compressive member located in the outer poppet chamber and positioned to bias the inner poppet to its closed position; and d. an opening mechanism that independently engages said inner and outer poppets to move said poppets from closed to open positions, said opening mechanism opening the inner poppet prior to opening the outer poppet.

11. The valve assembly of claim 10, wherein the opening mechanism comprises a valve stem having a first end and a second end, the first end operatively engaging the inner poppet, wherein axial movement of the valve stem moves the inner poppet and outer poppet between their respective open and closed positions.

12. The valve assembly of claim 10, further comprising an outer poppet seal adjacent a bottom surface of the outer poppet.

13. The valve assembly of claim 10, further comprising an inner poppet seal between the inner poppet and the valve seat, said inner poppet seal being capable of sealing against the valve seat when the inner poppet is in its closed position.

14. The valve assembly of claim 13, further comprising a retainer located within the outer poppet chamber to maintain the compressive member, the inner poppet and the inner poppet seal within the body chamber of the outer poppet.

15. The valve assembly of claim 14, further comprising an engagement member along the valve stem, said engagement member operatively engaging the outer poppet to move said outer poppet to its open position upon the upward movement of the valve stem.

16. The valve assembly of claim 15, wherein said engagement member comprises a retaining ring on said valve stem.

17. The valve assembly of claim 15, further comprising a skirt that encircles the valve stem between the engagement member and the outer poppet, said engagement member operatively engaging the skirt to move said outer poppet to its open position upon the upward movement of the valve stem.

* * * * *